US009401114B2

(12) United States Patent
Lin et al.

(10) Patent No.: US 9,401,114 B2
(45) Date of Patent: Jul. 26, 2016

(54) IMAGE DISPLAY APPARATUS, DISPLAY CONTROL APPARATUS THEREOF, AND SCALER CHIP IMAGE

(75) Inventors: Wen-Chi Lin, Yilan County (TW); Hsing-Chuan Chen, Taichung (TW)

(73) Assignee: Novatek Microelectronics Corp., Hsinchu (TW)

( * ) Notice: Subject to any disclaimer, the term of this patent is extended or adjusted under 35 U.S.C. 154(b) by 349 days.

(21) Appl. No.: 13/598,598

(22) Filed: Aug. 29, 2012

(65) Prior Publication Data

US 2013/0120471 A1 May 16, 2013

Related U.S. Application Data

(60) Provisional application No. 61/558,447, filed on Nov. 11, 2011.

(30) Foreign Application Priority Data

Dec. 28, 2011 (TW) ..... 100149293 A

(51) Int. Cl.
*G09G 3/34* (2006.01)
*G09G 5/10* (2006.01)

(52) U.S. Cl.
CPC ..... *G09G 3/342* (2013.01); *G09G 2320/0285* (2013.01); *G09G 2320/064* (2013.01); *G09G 2320/0646* (2013.01); *G09G 2360/16* (2013.01)

(58) Field of Classification Search
CPC ..... G09G 3/342; G09G 2320/0646; G09G 2320/0285; G09G 2360/16; G09G 2320/064
USPC ..... 345/77, 102, 690; 315/297
See application file for complete search history.

(56) References Cited

U.S. PATENT DOCUMENTS 8,564,528 B1 * 10/2013 Chen et al. ..... 345/102
2009/0066715 A1 * 3/2009 Chen ..... G09G 3/3406 345/589

(Continued)

FOREIGN PATENT DOCUMENTS

TW 201003632 1/2010
TW 201025261 7/2010

(Continued)

OTHER PUBLICATIONS

"Office Action of China Counterpart Application", issued on Aug. 5, 2014, p. 1-p. 4.

(Continued)

*Primary Examiner* — Alexander Eisen
*Assistant Examiner* — Abhishek Sarma
(74) *Attorney, Agent, or Firm* — Jianq Chyun IP Office

(57) ABSTRACT

A display control apparatus applied for an image display apparatus having a plurality of display regions is provided. The display regions are respectively corresponding to a plurality of backlight modules and the luminance of the backlight modules are independently controlled. The display control apparatus includes a backlight control unit. The backlight control unit receives a first image data to generate a plurality of local backlight control signals accordingly. The local backlight control signals are used for controlling the luminance of the backlight modules. The backlight control unit divides the first image data to be a plurality of local image data respectively corresponding to the display regions. Furthermore, the backlight control unit generates one of the local backlight control signals according to one of the local image data respectively.

21 Claims, 5 Drawing Sheets

(56) References Cited

U.S. PATENT DOCUMENTS

| | | | | |
|---|---|---|---|---|
| 2009/0267926 | A1* | 10/2009 | Seo et al. | 345/204 |
| 2010/0039368 | A1* | 2/2010 | Kim et al. | 345/102 |
| 2010/0149085 | A1* | 6/2010 | Kim et al. | 345/102 |
| 2011/0128302 | A1* | 6/2011 | Cho et al. | 345/690 |
| 2011/0141004 | A1* | 6/2011 | Kwon et al. | 345/102 |
| 2011/0148940 | A1* | 6/2011 | Byun et al. | 345/690 |
| 2011/0181202 | A1* | 7/2011 | Yu et al. | 315/297 |
| 2012/0019167 | A1* | 1/2012 | Chen et al. | 315/307 |
| 2012/0081407 | A1* | 4/2012 | Chiou et al. | 345/690 |

FOREIGN PATENT DOCUMENTS

| | | |
|---|---|---|
| TW | 201120864 | 6/2011 |
| TW | 201121337 | 6/2011 |
| TW | 201123158 | 7/2011 |

OTHER PUBLICATIONS

"Office Action of Taiwan Counterpart Application", issued on Feb. 21, 2014, p. 1-p. 11.

* cited by examiner

IMAGE DISPLAY APPARATUS, DISPLAY CONTROL APPARATUS THEREOF, AND SCALER CHIP IMAGE

CROSS-REFERENCE TO RELATED APPLICATION

This application claims the priority benefits of U.S. provisional application Ser. No. 61/558,447, filed on Nov. 11, 2011 and Taiwan application serial no. 100149293, filed on Dec. 28, 2011. The entirety of each of the above-mentioned patent applications is hereby incorporated by reference herein and made a part of this specification.

BACKGROUND OF THE INVENTION

1. Field of the Invention

The present invention relates to an image display apparatus, and more particularly to a display control apparatus with a Local Dimming mechanism.

2. Description of Related Art

Based on the concept of low energy consumption and environment protection in the modern technical field, the power saving requirement has become more and more important for designing a Liquid Crystal Display (LCD) apparatus. Regarding to the energy consumption of the LCD apparatus, a backlight panel applied in the LCD apparatus usually consumes the most energy. Therefore, how to control the energy consumption of the backlight panel is an important topic to the person who skilled in the art.

Speaking to the backlight panel formed by a plurality of Light Emitting Diode (LED) strings, the luminance of the backlight panel can be controlled by adjusting the luminance of each LED string in different time period according to the luminance of displaying image in order to reach the target of power saving. However, the conventional image control technology employs a lot of image analyzing technologies and a large size memory to complete the computation of the backlight luminance without affecting the display quality. Under such structure, a large size chip is required for executing the complex computation, and the large size memory has to be disposed outside the chip. Therefore, the production cost is raised as well.

SUMMARY OF THE INVENTION

The disclosure is directed to an image display apparatus and a display control apparatus thereof, and the image display apparatus can effectively reduce the energy consumption and maintain the display quality.

The display control apparatus adapted for the image display apparatus having a plurality of display regions is provided. The above-mentioned display regions are respectively corresponding to a plurality of backlight modules. The luminance of each backlight module can be controlled by the display control apparatus independently, and the display control apparatus includes a backlight control unit. The backlight control unit receives a first image data and generates a plurality of local backlight control signals accordingly. The local backlight control signals are used for respectively controlling the luminance of the backlight modules. In addition, the backlight control unit divides the first image data into a plurality of local image data corresponding to the display regions respectively. Moreover, the backlight control unit further generates each of the local backlight control signals according to a corresponding one of the plurality of local image data, respectively.

In one embodiment, the display control apparatus further includes an image adjusting unit. The image adjusting unit receives a plurality of local backlight duty signals corresponding to the backlight modules from the backlight control unit, and converts the first image data to the second image data according to the local backlight duty signals for driving a display panel.

On the other hand, a display control apparatus including a plurality of backlight modules, the display panel and the display control apparatus described above is provided. The display panel has a plurality of display region respectively corresponding to the plurality of backlight modules mentioned above. The display control apparatus is configured to control the luminance of the backlight modules independently. The display control apparatus is configured to control the luminance of the backlight modules independently.

Furthermore, a monitor scaler chip including a local dimming engine which has the display control apparatus described above and a scaler for providing the image data to the local dimming engine is provided.

According to the above descriptions, the display control apparatus provided in the disclosure divides the image data into the plurality of local image data so as to generate the plurality of local backlight control signals belonging to the different display regions. By adjusting the backlight of each display regions, power saving can be achieved.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

For the following description including claims, the term "couple" in the description below means two objects are connected directly or connected through at least one element or a medium between the objects. For instance, if a first apparatus is coupled to a second apparatus, it should be explained as that the first apparatus is directly connected to the second apparatus, or the first apparatus is connected to the second apparatus through at least an element or a medium.

Figure 1:
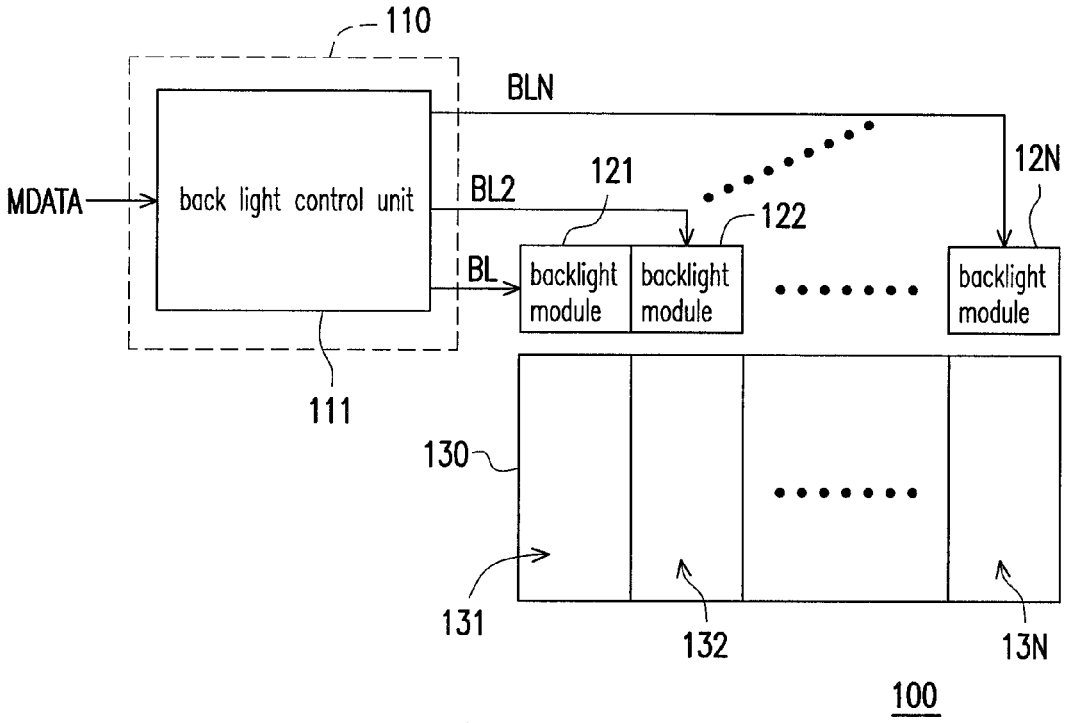
FIG. 1 illustrates a schematic view of an image display apparatus 100 according to an embodiment of the present invention.

Referring to FIG. 1, FIG. 1 illustrates a schematic view of an image display apparatus 100 according to an embodiment of the invention. The image display apparatus 100 includes a display control apparatus 100, backlight modules 121-12N and a display panel 130. The display panel 130 of the image display apparatus 100 is divided into a plurality of display regions 131-13N corresponding to the backlight modules 121-12N respectively. The backlight modules 121-12N can be coupled to the display control apparatus 110 and controlled by a plurality of local backlight control signals BL1-BLN independently and individually. The N described above is a positive integer.

The display control apparatus 110 includes a back light control unit 111. The backlight control unit 111 receives image data MDATA and generates the plurality of local backlight control signals BL1-BLN respectively corresponding to the display regions 131-13N of the display panel 130 according to the image data MDATA. In addition, the backlight control unit 111 further controls the luminance of the backlight modules 121-12N individually by the local backlight control signals BL1-BLN. To be more specific, the backlight control unit 111 divides the image data MDATA into a plurality of local image data according to or corresponding to the different display regions 131-13N on the display panel where the image data MDATA is to be displayed. Moreover, the backlight control unit 111 further generates the local backlight control signal of the backlight module corresponding to one of the display regions according to the local image data respectively.

For an example, the backlight control unit 111 divides the image data MDATA into a plurality of local image data ZD1-ZDN according to or corresponding to the different display regions 131-13N on the display panel where the image data MDATA is to be displayed. The backlight control unit 111 generates the local backlight control signal BL1 of the backlight module 121 corresponding to the display region 131 according to the local image data ZD1, and generates the local backlight control signal BL2 of the backlight module 122 corresponding to the display region 132 according to the local image data ZD2. Similar deduction for the other display regions can be made from the previous description.

Figure 2:
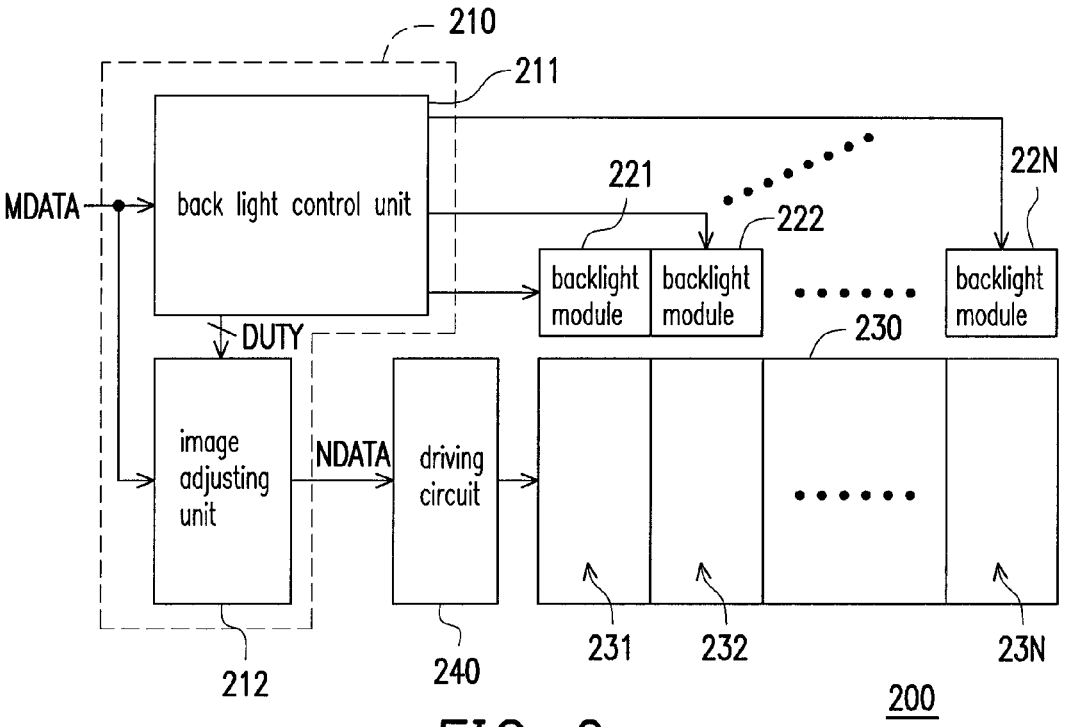
FIG. 2 illustrates a schematic view of an image display apparatus 200 according to another embodiment of the present invention.

Referring to FIG. 2, FIG. 2 illustrates a schematic view of an image display apparatus 200 according to another embodiment of the invention. The image display apparatus 200 includes a display control apparatus 210, backlight modules 221-22N, a display panel 230 and a driving circuit 240. The display panel 230 of the image display apparatus 200 is divided into a plurality of display regions 231-23N corresponding to the backlight modules 221-22N respectively. The backlight modules 221-22N are coupled to the display control apparatus 210 and controlled by a plurality of backlight control signals BL1-BLN independently and individually. The N described above is a positive integer. The driving circuit 240 is configured for generating a driving signal in order to drive the display panel 230.

The display control apparatus 210 includes a backlight control unit 211 and an image adjusting unit 212. The backlight control unit 211 divides the image data MDATA into a plurality of local image data according to or corresponding to the different display regions 131-13N on the display panel 230 where the image data MDATA is to be displayed. Moreover, the backlight control unit 111 further generates the local backlight control signal of the backlight module corresponding to each of the display regions according to the local image data respectively. The backlight control unit 211 has the same function and operation as the backlight control unit 111 in the previous embodiment, and the detail is not repeated herein. The image adjusting unit 212 receives a plurality of local backlight duty signals DUTY generated by the backlight control unit 211 and respectively corresponding to the plurality of backlight modules. The image adjusting unit 212 further receives the image data MDATA, and converts the image data MDATA to the image data NDATA according to the local backlight duty signals DUTY. The image data NDATA is transmitted to the driving circuit 240 by the image adjusting unit 212, so that the driving circuit 240 can generate driving signals for driving the display panel 130 according to the image data NDATA.

It should be noted that, in the embodiments of the FIG. 1 and FIG. 2, the display panels 130/230 is divided into N display regions 131-13N/231-23N which have the same size and disposed side by side. However, in other embodiments, the display regions can be designed to have different sizes and arranged in different patterns according to the design requirement. Moreover, the backlight modules 121-12N/221-22N are illustrated as disposed at one side of the display panel 130/230. However, in other embodiments, the backlight modules can be disposed at more than one side of the display panel, such as two opposite sides of the display panel.

Furthermore, it should be mentioned that the display control apparatus can be disposed in a monitor scaler chip as a local dimming engine. The monitor scaler chip further includes a scaler for providing the image data MDATA to the backlight control unit 210 and the image adjusting unit 212 in the local dimming engine. An input signal received by the monitor scaler chip can be the image signal such as VGA(D-SUB), DVA, HDMI and etc., and the output signal generated by the monitor scaler chip includes the image data NDATA and the backlight control signals BL1-BLN. The image data NDATA are generated for controlling the driving circuit 240 and display panel 230, and the backlight control signals BL1-BLN are generated for controlling the backlight modules 221-22N.

Figure 3:
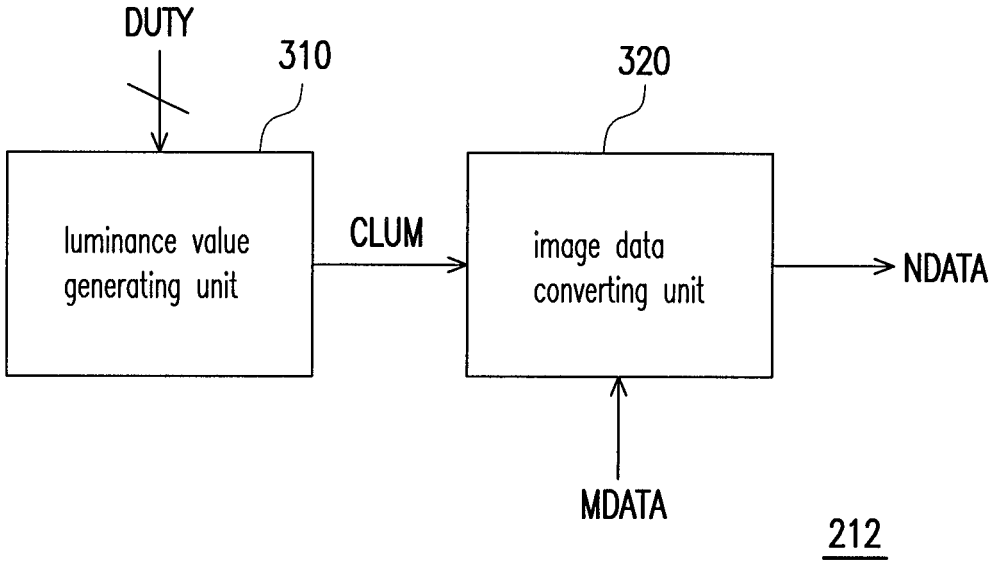
FIG. 3 illustrates a schematic view of an image adjusting unit 212 according to an embodiment of the present invention.

Referring to FIG. 3, FIG. 3 illustrates a schematic view of an image adjusting unit 212 according to an embodiment of the present invention. The image adjusting unit 212 includes a luminance value generating unit 310 and an image data converting unit 320. The luminance value generating unit 310 generates a luminance value CLUM for each position in the display regions of the image data according to the plurality of local backlight duty signals DUTY.

It should be noted that, referring to the FIG. 2 and FIG. 3, a displayed pixel is not only affected by the luminance of the backlight module which is corresponding to the display region where the displayed pixel located, and also affected by luminance of the other backlight modules. Taking the pixel in display region 231 as an example, the pixel is not only affected by the luminance of the backlight module 211, but also affected by the luminance of the other backlight modules 222-22N. Therefore, it is preferable for the luminance value generating unit 310 to generate the luminance value CLUM according to each position in the display regions. In other words, the luminance generating unit 310 generates the luminance value not only according to the local backlight duty signal DUTY corresponding to the display region where the position located, but also according to the other local backlight duty signals DUTY corresponding to the other display regions.

The image data converting unit 320 is coupled to the luminance value generating unit 310 for receiving the luminance value CLUM generated by the luminance value generating unit 310. For each pixel of the image data MDATA, the image data converting unit 320 converts a first pixel value of the pixel to a second pixel value to obtain the converted image data NDATA according to the position where the pixel is located in the display region and the luminance value CLUM corresponding to the display region where the pixel is located.

Figure 4:
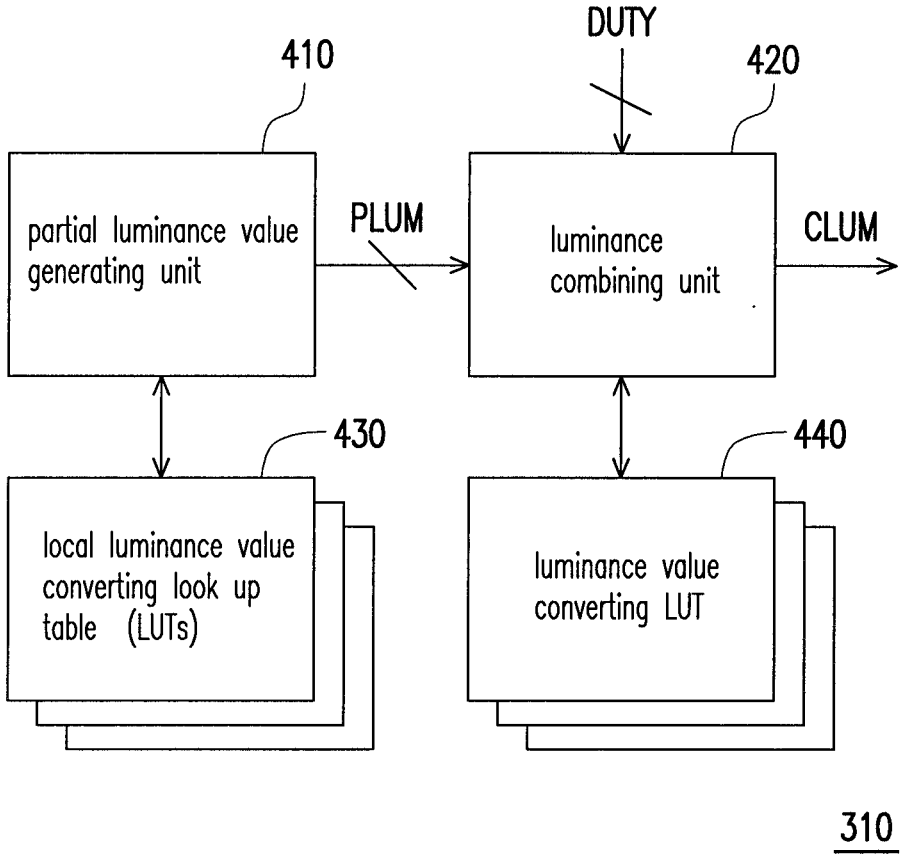
FIG. 4 illustrates a schematic view of a luminance value generating unit 310 according to an embodiment of the present invention.

Referring to FIG. 2 and FIG. 4, FIG. 4 illustrates a schematic view of a luminance value generating unit 310 according to an embodiment of the present invention. The luminance value generating unit 310 includes a partial luminance value generating unit 410, a luminance combining unit 420 and a plurality of local luminance value converting look up tables 430 (LUTs). Also, the luminance value generating unit 310 further includes a plurality of luminance value converting LUTs 440.

The partial luminance value generating unit 410 is coupled to the luminance value combining unit 420 and all the local luminance value converting LUTs 430. The partial luminance value generating unit 410 searches a plurality of partial luminance values PLUM from each of the local luminance LUTs 430. Each of the local luminance value converting LUTs 430 respectively corresponds to one of the backlight modules 221-22N. Preferably, each of the local luminance value converting LUTs 430 respectively records a plurality of luminance values (partial luminance values, hereinafter PLUM) corresponding to the plurality of the display regions (it is preferred to be all the positions) in a condition that one of the backlight modules which is corresponding to the local luminance value converting LUT has the maximum luminance and the other backlight modules have the minimum luminance. Taking the display region 231 as an example, in setting the local luminance value converting LUT 430 corresponding to the backlight module 221, the backlight module 221 can be set to have the maximum luminance, and the other backlight modules 222-22N can be set to have the minimum luminance in order to measure all the luminance values of the display regions 231-23N to be the partial luminance values PLUM of the local luminance value converting LUT 430.

The luminance value combining unit 420 receives the plurality of partial luminance values PLUM and the plurality of local backlight duty signals DUTY, and combines the received partial luminance values into a luminance value CLUM according to the received local backlight duty signals DUTY for each of the positions in the display regions. Preferably, the luminance value combining unit 420 generates a plurality of weighted values according to the corresponding local backlight duty signals to perform a weighted multiplication with the partial luminance values PLUMs corresponding to each of the positions in the display regions in order to generate the luminance value CLUM.

In one embodiment, the values of the local backlight duty signals can linearly correspond to the luminance values CLUM. However, in another embodiment, considering to the nonlinear correlation between the backlight duty signal DUTY and the luminance value CLUM, the luminance value combining unit 420 can be further coupled to a luminance value converting LUT 440. Each of the luminance value converting LUTs 440 corresponds to one of the backlight modules 221-22N, and records the plurality of the weighted values corresponding to a plurality of duty cycles of the local backlight duty signal corresponding to the backlight module. Therefore, the luminance value combining unit 420 receives the local backlight duty signal DUTY corresponding to each of the backlight modules, and searches the luminance value converting LUTs corresponding to the backlight module according to the local backlight duty signal DUTY in order to obtain a plurality of weighted values of backlight modules 221-22N. Next, the luminance value combining unit 420 performs the weighted multiplication on the weighted values and the corresponding partial luminance values PLUM to obtain the luminance value CLUM.

Figure 5:
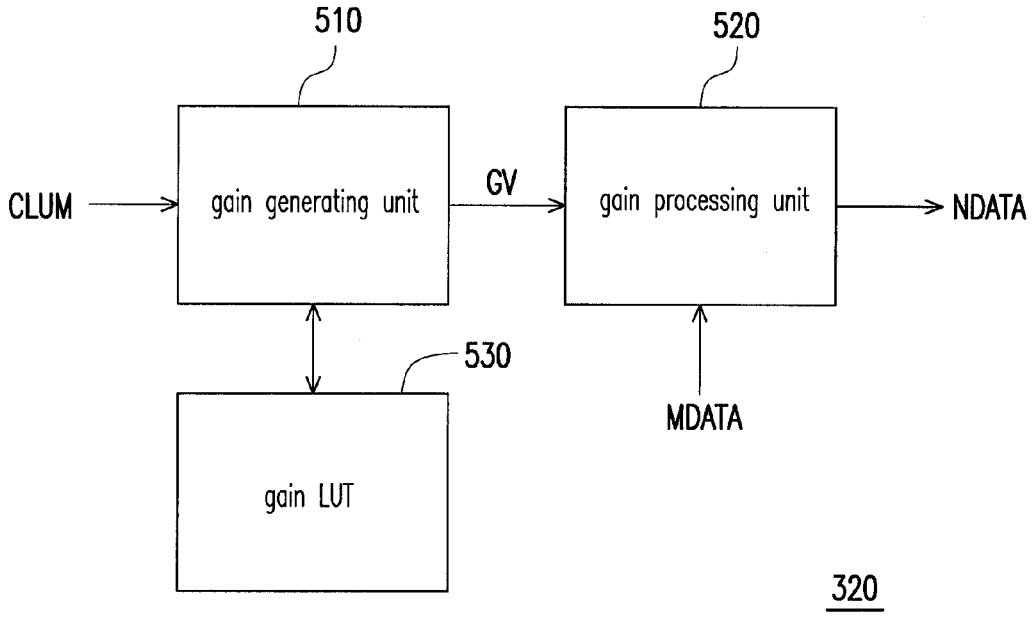
FIG. 5 illustrates a schematic view of an image data converting unit 320 according to an embodiment of the present invention.

Referring to FIG. 5, FIG. 5 illustrates a schematic view of an image data converting unit 320 according to an embodiment of the present invention. The image data converting unit 320 includes a gain generating unit 510, a gain processing unit 520 and a gain LUT 530. The gain generating unit 510 receives the luminance values CLUM generated by the luminance value generating unit 320. For each of the positions in the display regions, the gain generating unit 510 can generate a gain value GV according to one of the luminance values CLUM corresponding to the position.

The gain processing unit 520 is coupled to the gain generating unit 510 and receives the gain values GV generated by the gain generating unit 510. For each of the positions in the display region, the gain processing unit 520 converts a first pixel value of the position in the image data MDATA into a second pixel value of the same position in the image data NDATA according to the gain value GV corresponding to the position in the display region.

Figure 6:
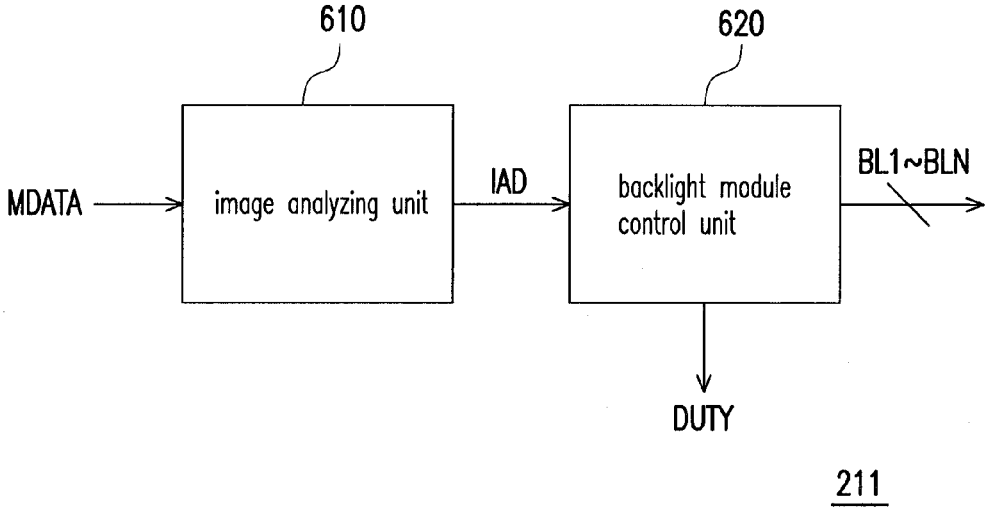
FIG. 6 illustrates a schematic view of a display control apparatus 211 according to an embodiment of the present invention.

Referring to FIG. 2 and FIG. 6, FIG. 6 illustrates a schematic view of a display control apparatus 211 in an embodiment of the present invention. The backlight control unit 211 includes an image analyzing unit 610 and a backlight module control unit 620. The image analyzing unit 610 receives the image data MDATA and computes a plurality of image analysis data IAD respectively corresponding to the plurality of display regions according to the image data MDATA. For instance, the image analyzing unit 610 computes an average value or/and a maximum value of the pixel data in each of display regions to obtain the image analysis data IAD.

The backlight module control unit 620 is coupled to the image analyzing unit 610 and respectively generates the local backlight control signal (one of the local backlight control signal BL1-BLN) of the display region (one of the display regions 231-23N) according to one of the plurality of image analysis data IAD which are corresponding to the plurality of display regions. For example, the image analysis data IAD includes the local image data ZD1-ZDN respectively corresponding to the display regions 231-23N. Accordingly, the backlight module control unit 620 generates the local back light control signal BL1 of the backlight module 121 corresponding to the display region 131 according to the local image data ZD1, and generates the local back light control signal BL2 of the backlight module 122 corresponding to the display region 132 according to the local image data ZD2. Similar deduction for the other display regions can be made from the previous description.

Figure 7:
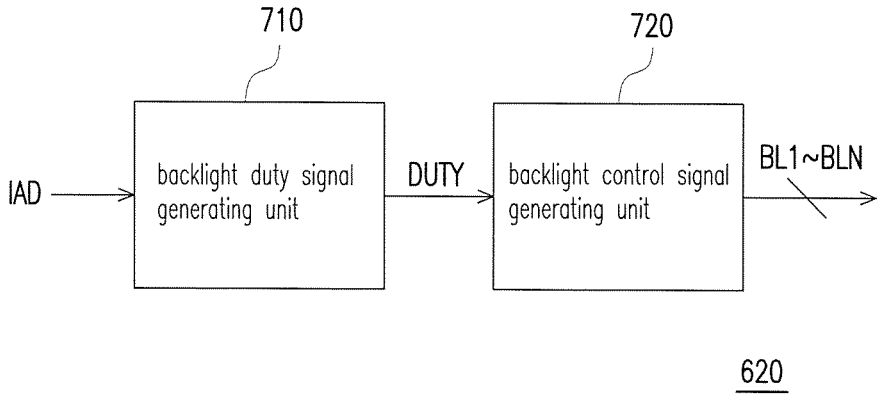
FIG. 7 illustrates a schematic view of a backlight module control unit 620 according to an embodiment of the present invention.

Referring to FIG. 2 and FIG. 7, FIG. 7 illustrates a schematic view of a backlight module control unit 620 according to an embodiment of the present invention. The backlight module control unit 620 includes a backlight duty signal generating unit 710 and a backlight control signal generating unit 720. The backlight duty signal generating unit 710 generates the plurality of local backlight duty signals DUTY according to the received image analysis data IAD. The local backlight duty signals DUTY respectively indicate the duty cycles of the backlight module 221-22N. In brief, the longer the duty cycle of the backlight modules 221-22N indicated by the local backlight duty signal DUTY, the higher the average luminance generated by the backlight modules 221-22N.

The backlight control signal generating unit 720 is coupled to the backlight duty signal generating unit 710 for generating the plurality of local backlight control signals BL1-BLN according to the plurality of local backlight duty signals DUTY.

Figure 8:
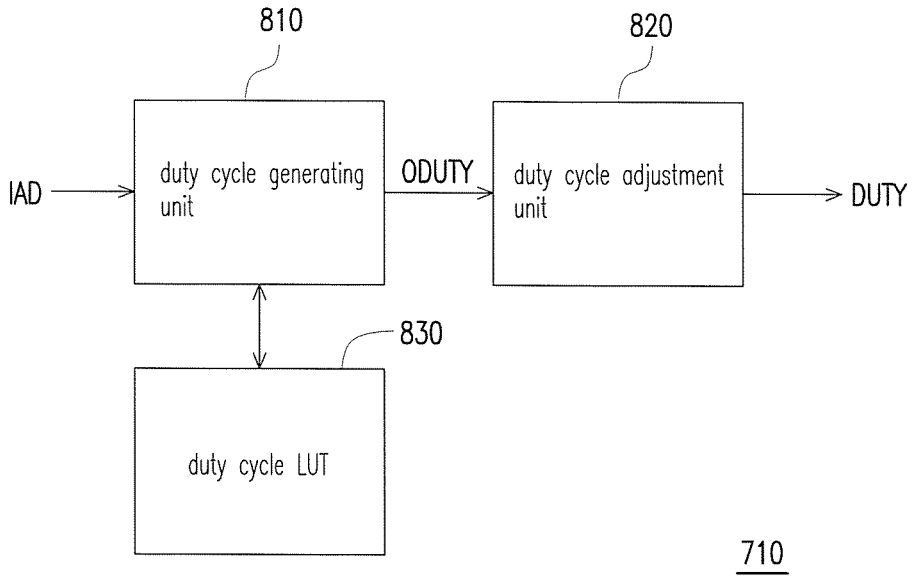
FIG. 8 illustrates a schematic view of a backlight duty signal generating unit 710 according to an embodiment of the present invention.

Referring to FIG. 8, FIG. 8 illustrates a schematic view of a backlight duty signal generating unit 710 according to an embodiment of the present invention. The backlight duty signal generating unit 710 includes a duty cycle generating unit 810 and a duty cycle LUT 830. The duty cycle generating unit 810 receives the plurality of image analysis data IAD to obtain a plurality of original local backlight duty signals ODUTY which respectively represent original duty cycles T_ODUTY. It should be noted that, the duty cycle generating unit 810 may employ the duty cycle LUT 830 to obtain the original duty cycles T_ODUTY, where the duty cycle LUT 830 records the plurality of original duty cycles T_ODUTY respectively corresponding to the plurality of image analysis data IAD.

Preferably, the backlight duty signal generating unit 710 can further include a duty cycle adjustment unit 820. The duty cycle adjustment unit 820 can be coupled to the duty cycle generating unit 810 for adjusting the original local backlight duty signals ODUTY (which represent to the plurality of original duty cycles T_ODUTY) to be the plurality of local backlight duty signals DUTY (which represent to the duty cycles T_). For instance, the duty cycle adjustment unit 820 adjusts the original duty cycles T_ODUTY to obtain the duty cycles T_DUTY by the processes such as smoothing process or/and debouncing process.

It should be noted that, the duty cycles T_DUTY are provided to both the backlight control signal generating unit 720 and the image adjustment unit 212 in previous embodiments. However, in other embodiments, one of the original local backlight duty signal ODUTY and the local backlight duty signal DUTY is provided to the image adjustment unit 210 or the backlight control signal generating unit 720. Moreover, the duty signals provided to the backlight control signal generating unit 720 and the image adjustment unit 212 can be different. For example, one of the duty signals is adjusted, but the other one is original. Furthermore, the duty signals provided to the backlight control signal generating unit 720 and the image adjustment unit 212 can be adjusted with different processes.

Figure 9A:
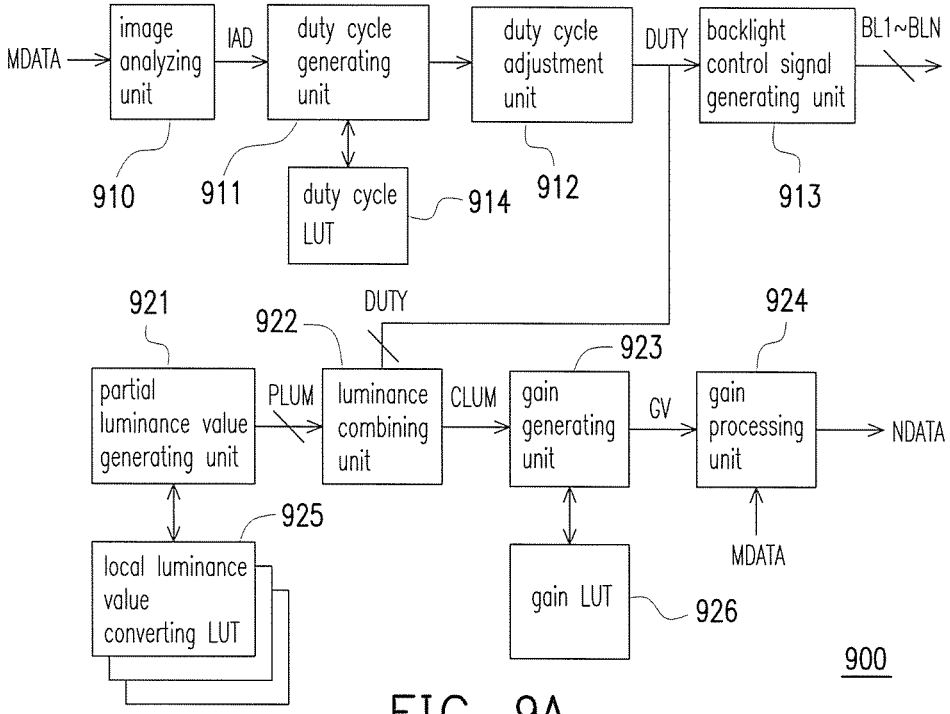
FIG. 9A and FIG. 9B respectively illustrate a schematic view of an image display apparatus 900 according to different embodiments.
Figure 9B:
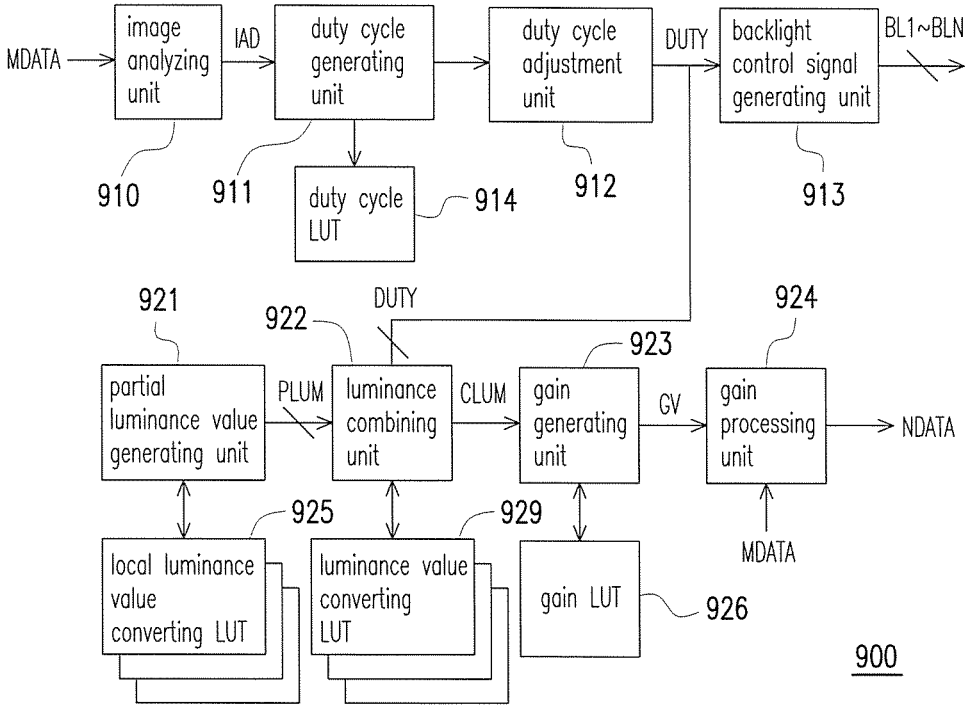

Referring to FIG. 9A and FIG. 9B, FIG. 9A and FIG. 9B respectively illustrates a schematic view of an image display apparatus 900 according to different embodiments. In the embodiment of FIG. 9A, the image display apparatus 900 includes the image analyzing unit 910, the duty cycle generating unit 911, the duty cycle adjustment unit 912, the backlight control signal generating unit 913, the duty cycle LUT 914, the partial luminance value generating unit 921, the luminance value combining unit 922, the gain generating unit 923, the gain processing unit 924, the local luminance value converting LUT 925 and the gain LUT 926.

The image analyzing unit 910 receives the image data MDATA and processes a computation for each of the display regions to which the pixels of the image data MDATA belong. For instance, the image analyzing unit 910 computes the average value or/and the maximum value of the pixel data for each of the display regions to obtain the image analysis data IAD. The duty cycle generating unit 911 searches the duty cycle LUT 914 to obtain the original duty cycles T_ODUTY respectively corresponding to the display regions according to the image analysis data IAD. The duty cycle adjustment unit 912 adjusts the original duty cycles T_ODUTY to obtain the duty cycles T_DUTY.

The partial luminance value generating unit 921, the luminance value combining unit 922, the gain generating unit 923, the gain processing unit 924, the local luminance LUT 925 and the gain LUT 926 are used for adjusting the image data MDATA so as to generate the adjusted image data NDATA according to the local backlight duty signals DUTY and the affection of all the backlight modules on the pixels of the display regions desired to be displayed. In this embodiment, when then local backlight duty signals DUTY and the luminance values CLUM are linearly correlated, the luminance value combining unit 922 can easily convert the first partial luminance value PLUM to obtain the luminance value CLUM.

In addition, referring to FIG. 9B, in FIG. 9B, the image display apparatus includes the plurality of luminance value converting LUTs 929. The luminance converting LUTs 929 are employed for a condition in which there exists a complex and non-linear correlation between local backlight duty signals DUTY and the luminance values CLUM, and the luminance value converting LUTs are provided to be a look-up basis for the luminance value combining unit 922 in order to simplify the computation made by the luminance value combining unit 922. Additionally, the luminance value converting LUT 929 may be built in a memory. The functions of the components illustrated in FIG. 9A and FIG. 9B are already described in the previous embodiments and description, and the details will not be repeated herein.

In summary, in the previous described embodiments, the image data desired to be displayed can be divided into a plurality of local image data according to the display regions divided for the display apparatus. Furthermore, in the previous described embodiments, for each of the display regions, one of the plurality of local backlight control signals can be generated according to the luminance value of the image data. Therefore, the luminance value of the backlight module in each display region can be related to the luminance value of the image data displayed in the display region. Accordingly, the display control apparatus may not only maintain the display quality but also reduce the energy consumption.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A display control apparatus, adapted for an image display apparatus, wherein the image display apparatus has a plurality of display regions, the display regions are respectively corresponding to a plurality of backlight modules, the luminance of the backlight modules are controlled by the display control apparatus, the display control apparatus comprising:

a backlight control unit, receiving a first image data to generate a plurality of local backlight control signals so as to control the luminance of the plurality of backlight modules, respectively, wherein the backlight control unit divides the first image data into a plurality of local image data respectively corresponding to the plurality of display regions, and the backlight control unit further generates one of the plurality of local backlight control signals according to a corresponding one of the local image data; and an image adjusting unit, receiving a plurality of local backlight duty signals respectively corresponding to the plurality of backlight modules from the backlight control unit, and converts the first image data to a second image data for driving a display panel according to the plurality of local backlight duty signals, wherein, the image adjusting unit respectively converts, for each one of a plurality of positions, a first pixel value of the position in the first image data to be a second pixel value of the position in the second image data according to at least two of the plurality of local backlight duty signals corresponding to at least two of display regions.

2. The display control apparatus according to claim 1, wherein the image adjusting unit comprises:

a luminance value generating unit, respectively generating a luminance value according to the plurality of local backlight duty signals for each of the plurality of positions; and an image data converting unit, configured to, for each of the plurality of positions, convert the first pixel value of the position in the first image data to be the second pixel value of the position in the second image data according to the luminance value.

3. The display control apparatus according to claim 2, wherein the luminance value generating unit comprises:

a partial luminance value generating unit, configured to, for each of the positions, generate a plurality of partial luminance values respectively corresponding to the plurality of backlight modules; and a luminance value combining unit, configured to, for each of the positions, combine the plurality of partial luminance values into the luminance value according to the plurality of local backlight duty signals.

4. The display control apparatus according to claim 3, wherein the partial luminance value generating units employs a plurality of local luminance value converting look up tables (LUT) to search the plurality of partial luminance values, each of the plurality local luminance LUTs is corresponding to one of the backlight modules, and each of the plurality local luminance LUTs records a plurality of local luminance values respectively corresponding to the positions in a condition that the backlight module has the maximum luminance.

5. The display control apparatus according to claim 3, wherein the luminance value combining unit performs a weighted multiplication on the plurality of partial luminance values according to a plurality of weighted values which respectively represent the plurality of local backlight duty signals so as to generate the luminance value for each of the positions.

6. The display control apparatus according to claim 5, wherein the luminance value combining units employs a plurality of luminance value converting LUTs to search the plurality of weighted values according to the plurality of local backlight duty signals, and to generate the luminance value according to the plurality of weighted values and the plurality of partial luminance values.

7. The display control apparatus according to claim 6, wherein each of the luminance value converting LUTs is corresponding to one of the plurality of backlight modules, and records the plurality of weighted values which are respectively corresponding to a plurality of duty cycles of the local backlight duty signal corresponding to the backlight module.

8. The display control apparatus according to claim 2, wherein the image data converting unit comprises:

a gain generating unit, generating a gain according to the luminance value for each of the positions; and a gain processing unit, configured to, for each of the positions, convert the first pixel value of the position in the first image data to the second pixel value of the position in the second image data according to the gain.

9. The display control apparatus according to claim 8, wherein the image data converting unit obtains the second pixel value according to a gain LUT, the gain LUT is configured for recording the plurality of gains respectively corresponding to the plurality of luminance values.

10. The display control apparatus according to claim 1, wherein the backlight control unit comprises:

an image analyzing unit, computing a plurality of image analysis data respectively corresponding to the plurality of display regions according to the image data; and a backlight module control unit, coupled to the image analyzing unit, wherein the backlight module control unit generates one of the plurality of local backlight control signals according to a corresponding one of the plurality of image data analysis data which are respectively corresponding to the plurality of display regions.

11. The display control apparatus according to the claim 10, wherein each of the plurality of image analysis data comprises an average value or a maximum value of the plurality of pixels in the display region corresponding to the image analysis data.

12. The display control apparatus according to claim 10, wherein the backlight module control unit comprises:

a backlight duty signal generating unit, configured for generating a plurality of local backlight duty signals according to the plurality of image analysis data, wherein the plurality of local backlight duty signals respectively indicate a plurality of duty cycles of the backlight modules; and a backlight control signal generating unit, configured for generating the plurality of local backlight control signals according to the plurality of local backlight duty signals.

13. The display control apparatus according to claim 12, wherein the backlight duty signal generating unit comprises:

a duty cycle generating unit, configured for obtaining a plurality of original duty cycles according to the plurality of image analysis data, wherein the plurality of original duty cycles are employed for generation of the plurality of duty cycles.

14. The display control apparatus according to claim 13, wherein the backlight duty signal generating unit comprises:

a duty cycle adjustment unit, configured for adjusting the plurality of original duty cycles to be the duty cycles.

15. The display control apparatus according to the claim 13, wherein the duty cycle generating unit employs a duty cycle LUT to obtain the plurality of original duty cycles, the duty cycle LUT records the plurality of original duty cycles respectively corresponding to the plurality of image analysis data.

16. The display control apparatus according to the claim 13, wherein the duty cycle generating unit employs a plurality of duty cycle LUTs to obtain the plurality of original duty cycles, the plurality of duty cycles LUTs respectively corresponding to the one of the backlight modules, and records the plurality of original duty cycles respectively corresponding to the plurality of image analysis data.

17. An image display apparatus, comprising:

a plurality of backlight modules;

a display panel, having a plurality of display regions, wherein the display regions respectively corresponding to the plurality of backlight modules; and a display control unit claimed in claim 1, configured for independently controlling luminance of the backlight modules.

18. A monitor scaler chip, comprising:

a local dimming engine, comprising a display control apparatus claimed in claim 1; and a scaler, configured for providing image data to the local dimming engine.

19. A display control method for controlling an image display apparatus, wherein the image display apparatus has a plurality of display regions, the display regions are respectively corresponding to a plurality of backlight modules, the display control method comprising:

(i) generating a plurality of first signals for controlling a plurality of duty cycles of the plurality of backlight modules, respectively (ii) converting a first image data to a second image data for driving a display panel according to the duty cycles of at least two of the plurality of backlight modules corresponding to at least two of display regions, such that a respective pixel value at each of a plurality of positions of the second image data depends on the duty cycles of respective multiple ones of the plurality of backlight modules.

20. The display control method according to claim 19, wherein in step (i), the plurality of first signals are generated according to the first image data.

21. The display control method according to claim 20, wherein the first image data comprises local image data respectively corresponding to the plurality of display regions, and in step (i), the first signal for each of the backlight modules is generated according to the local image data corresponding to the same display region the backlight module respectively corresponds to.

* * * * *